US006650301B1

(12) United States Patent
Zimmerman

(10) Patent No.: US 6,650,301 B1
(45) Date of Patent: Nov. 18, 2003

(54) SINGLE PIECE TWIN FOLDED DIPOLE ANTENNA

(75) Inventor: Martin L. Zimmerman, Chicago, IL (US)

(73) Assignee: Andrew Corp., Orland Park, IL (US)

( * ) Notice: Subject to any disclaimer, the term of this patent is extended or adjusted under 35 U.S.C. 154(b) by 0 days.

(21) Appl. No.: 10/175,315

(22) Filed: Jun. 19, 2002

(51) Int. Cl.[7] ..... H01Q 9/26
(52) U.S. Cl. ..... 343/803; 343/795
(58) Field of Search ..... 343/702, 747, 343/803, 795, 815, 818, 846

(56) References Cited

U.S. PATENT DOCUMENTS

| | | | | |
|---|---|---|---|---|
| 3,611,399 A | | 10/1971 | Rocke | 343/834 |
| 3,813,674 A | | 5/1974 | Sidford | 343/730 |
| 4,015,265 A | | 3/1977 | Dubost et al. | 343/747 |
| 4,038,662 A | | 7/1977 | Turner | 343/752 |
| 4,498,085 A | | 2/1985 | Schwarzmann | 343/795 |
| 4,686,536 A | | 8/1987 | Allcock | 343/700 MS |
| 5,495,260 A | | 2/1996 | Couture | 343/795 |
| 5,532,707 A | | 7/1996 | Klinger et al. | 343/793 |
| 5,539,414 A | | 7/1996 | Keen | 343/700 MS |
| 5,592,185 A | | 1/1997 | Itabashi et al. | 343/794 |
| 5,724,051 A | | 3/1998 | Mailandt et al. | 343/795 |
| 5,754,145 A | | 5/1998 | Evans | 343/795 |
| 5,917,456 A | | 6/1999 | Teunisse | 343/795 |
| 5,936,590 A | | 8/1999 | Funder | 343/795 |
| 5,940,044 A | | 8/1999 | Smith | 343/810 |
| 5,999,141 A | * | 12/1999 | Weldon | 343/803 |
| 6,037,912 A | | 3/2000 | DeMarre | 343/815 |
| 6,046,704 A | | 4/2000 | Lopez | 343/821 |
| 6,111,549 A | | 8/2000 | Feller | 343/795 |
| 6,208,311 B1 | | 3/2001 | Reece et al. | 343/795 |
| 6,211,840 B1 | | 4/2001 | Wood et al. | 343/793 |
| 6,222,496 B1 | | 4/2001 | Liu | 343/846 |
| 6,229,496 B1 | | 5/2001 | Eriksson | 343/795 |
| 6,239,766 B1 | | 5/2001 | Smith et al. | 343/841 |
| 6,285,336 B1 | | 9/2001 | Zimmerman | 343/803 |
| 6,317,099 B1 | * | 11/2001 | Zimmerman et al. | 343/803 |

* cited by examiner

*Primary Examiner*—Tan Ho
(74) *Attorney, Agent, or Firm*—Welsh & Katz, Ltd.

(57) ABSTRACT

A single piece twin folded dipole antenna for transmitting and receiving electromagnetic signals is provided. The antenna includes a conductor extending in a V-shape at an angle of approximately 45 degrees adjacent to a ground plane. The conductor includes a feed section, a radiator input portion, and a radiating portion. The radiator input portion includes a first radiator input section and a second radiator input section whereby the radiator input sections are integrally formed with the radiating portion. The radiating portion includes a first radiating section and a second radiating section connected in parallel whereby each radiating section includes a fed dipole and a passive dipole.

40 Claims, 8 Drawing Sheets

SINGLE PIECE TWIN FOLDED DIPOLE ANTENNA

FIELD OF THE INVENTION

The present invention relates generally to antennas. More particularly, it concerns a single piece twin folded dipole antenna for use in wireless telecommunications systems.

BACKGROUND OF THE INVENTION

Base station antennas used in wireless telecommunication systems have the capability to transmit and receive electromagnetic signals. Received signals are processed by a receiver at the base station and fed into a communications network. Transmitted signals are transmitted at different frequencies than the received signals.

Due to the increasing number of base station antennas, manufacturers are attempting to minimize the size of each antenna and reduce manufacturing costs. Moreover, the visual impact of base station antenna towers on communities has become a societal concern. Thus, it is desirable to reduce the size of these towers and thereby lessen the visual impact of the towers on the community. Using smaller base station antennas can reduce the size of the towers.

There is also a need for an antenna with wide impedance bandwidth which displays a stable far-field pattern across that bandwidth. There is also a need for increasing the bandwidth of existing single-polarization antennas so they can operate in the cellular, Global System for Mobile (GSM), Personal Communication System (PCS), Personal Communication Network (PCN), and Universal Mobile Telecommunications System (UMTS) frequency bands.

The present invention addresses the problems associated with prior antennas by providing a novel single piece twin folded dipole antenna including a conductor forming two integral radiating sections. This design exhibits wide impedance bandwidth, is inexpensive to manufacture, and can be incorporated into existing single-polarization antenna designs.

BRIEF DESCRIPTION OF THE DRAWINGS

Other objects and advantages of the invention will become apparent upon reading the following detailed description and upon reference to the accompanying drawings, in which.

Figure 1A:
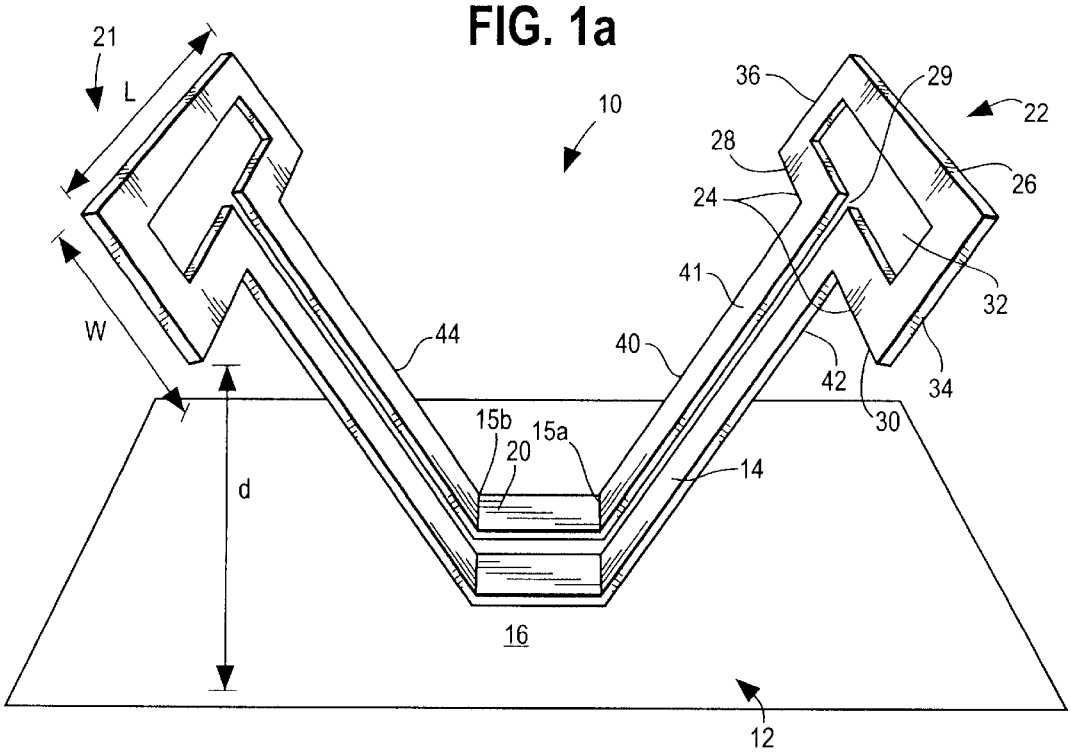
FIG. 1*a* illustrates an isometric view of a twin folded dipole antenna according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DETAILED DESCRIPTION

The present invention is useful in wireless, broadcast, military and other such communication systems. One embodiment of the present invention operates across various frequency bands, such as the North American Cellular band of frequencies of 824–896 MHz, the North American Trunking System band of frequencies of 806–869 MHz, the Global System for Mobile (GSM) band of frequencies of 870–960 MHz. Another embodiment of the invention operates across several different wireless bands such as the Personal Communication System (PCS) band of frequencies of 1850–1990 MHz, the Personal Communication Network (PCN) band of frequencies of 1710–1880 MHz, and the Universal Mobile Telecommunications System (UMTS) band of frequencies of 1885–2170 MHz. In-this embodiment, wireless telephone users transmit electromagnetic signals to a base station tower that includes a plurality of antennas which receive the signals transmitted by the wireless telephone users. Although useful in base stations, the present invention can also be used in all types of telecommunications systems.

Illustrated in FIGS. 1*a*–11 is a single piece twin folded dipole antenna 10 for transmitting and receiving electromagnetic signals. In FIGS. 1*a*–11, illustrated parts of the twin folded dipole antenna 10 that are identical have been identified by the same reference numerals throughout. The twin folded dipole antenna 10 includes a conductor 14 formed from a single sheet of conductive material. The conductor 14 has three sections, a feed section 20, a radiator input portion including radiator input sections 40 and/or 44, and a radiating portion including radiating sections 21 and/or 22. In one embodiment, the feed section 20 extends adjacent a ground plane 12 and is spaced therefrom by a dielectric, such as air, foam, etc., as shown in FIG. 1*b*. The radiating sections 21 and 22 are spaced at an angle from the surface or edge of the ground plane 12 in order to provide an antenna capable of wide bandwidth operation that still has a compact size.

The radiator input portion has two radiator input sections 40 and 44. The two illustrated radiator input sections 40, 44 are identical in construction, and thus only the radiator input section 40 will be described in detail. The radiator input section 40 consists of two conductor sections 41 and 42 separated by a gap 29. The two conductor sections 41 and 42 are ideally parallel with a constant gap. Whether or not ideal, the two conductor sections 41 and 42 are parallel conductors in the same plane. The conductor section 41 connects one part of the radiating section 22 to the feed section 20, and the conductor section 42 connects another part of the radiating section 22 to the ground plane 12. The radiator input section 40 has an intrinsic impedance that is adjusted to match the radiating section 22 to the feed section 20. This impedance is adjusted by varying the width of the conductor sections 41, 42 and the gap 29.

In the illustrated embodiments of FIGS. 1*a*–11, the twin folded dipole antenna 10 includes two radiating sections 21 and 22. The two radiating sections 21 and 22 are connected to each other in parallel. In the embodiment of FIGS. 1*a*–1*c*, the conductor 14 is mechanically and electrically connected to the ground plane 12 at one location 16. The radiating sections 21, 22 are supported at a distance d above the ground plane 12. In the wireless frequency band (1710–2170 MHz) embodiment, the distance d=1.22". The conductor 14 is bent at bends 15*a* and 15*b* such that the feed section 20 is supported by and displaced from the ground plane 12, as illustrated schematically in FIG. 1*b*. As a result, the feed section 20 is generally parallel to the ground plane 12. The feed section 20 includes an RF input section (not shown) that is adapted to electrically connect to a transmission line. The transmission line is generally electrically connected to an RF device such as a transmitter or a receiver. In one embodiment, the RF input section connects to an RF device.

The two illustrated radiating sections 21, 22 are identical in construction, and thus only the radiating section 22 will be described in detail. Radiating section 22 includes a fed dipole 24 and a passive dipole 26. The fed dipole 24 comprises a first quarter-wavelength monopole 28 and a second quarter-wavelength monopole 30. In one embodiment, the first quarter-wavelength monopole 28 is connected to one end of the conductor section 41. The other end of the conductor section 41 is connected to the feed section 20. The second quarter-wavelength monopole 30 is connected to one end of the conductor section 42, and the other end of conductor section 42 is connected to the ground plane 12 at location 16.

The conductor section 42 can be connected to the ground plane 12 by any suitable fastening device such as a nut and bolt, a screw, a rivet, or any suitable fastening method including soldering, welding, brazing, and cold forming. A suitable connection provides both electrical and mechanical connections between the conductor 14 and the ground plane 12. Thus, the twin folded dipole antenna 10 is protected from overvoltage and overcurrent conditions caused by transients such as lightning. One method of forming a good electrical and mechanical connection is the cold forming process available from Tox Pressotechnik GmbH of Weingarten, Germany (hereinafter "the cold forming process"). The cold forming process deforms and compresses one metal surface into another metal surface to form a Tox button. The cold forming process uses pressure to lock the two metal surfaces together. This process eliminates the need for separate mechanical fasteners to secure two metal surfaces together. Thus, in the embodiment where the radiating sections 21, 22 are attached to ground plane 12 by the cold forming process, the resulting Tox button at location 16 provides structural support to the radiating sections 21, 22 and provides an electrical connection to the ground plane 12. Attaching the conductor 14 to the ground plane 12 by the cold forming process minimizes the intermodulation distortion (IMD) of the antenna 10. Certain other types of electrical connections such as welding will also minimize the IMD of the twin folded dipole antenna 10.

The gap 32 forms a first half-wavelength dipole (passive dipole 26) on one side of the gap 32 and a second half-wavelength dipole (fed dipole 24) on the other side of the gap 32. The centrally located gap 29 separates the fed dipole 24 into the first quarter-wavelength monopole 28 and the second quarter-wavelength monopole 30. Portions of the conductor 14 at opposing ends 34 and 36 of the gap 32 electrically connect the fed dipole 24 with the passive dipole 26. The gap 29 causes the conductor sections 41 and 42 to form an edge-coupled stripline transmission line. Since this transmission line is balanced, it efficiently transfers EM power from the feed section 20 to the radiating section 22. In the embodiment of FIG. 1*a*, the ground plane 12 and the feed section 20 are generally angular to the radiating sections 21, 22 at an angle of approximately 45 degrees.

Figure 1B:
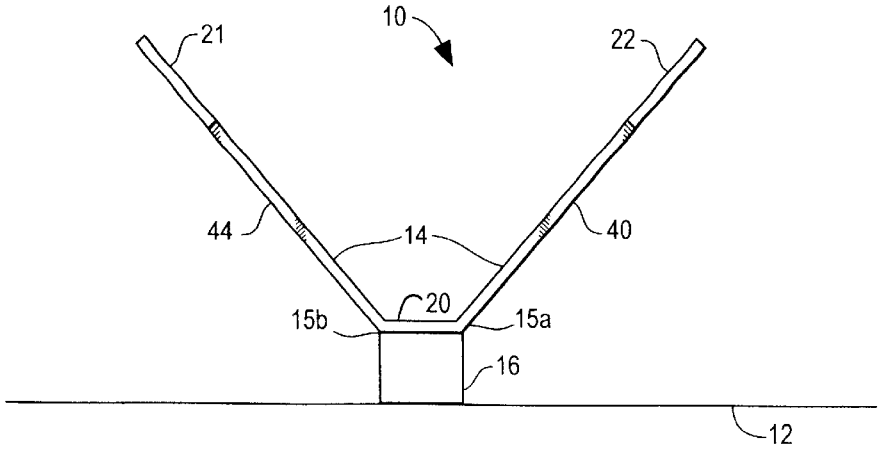
FIG. 1*b* illustrates a side view of the twin folded dipole antenna of FIG. 1*a;*
Figure 1C:
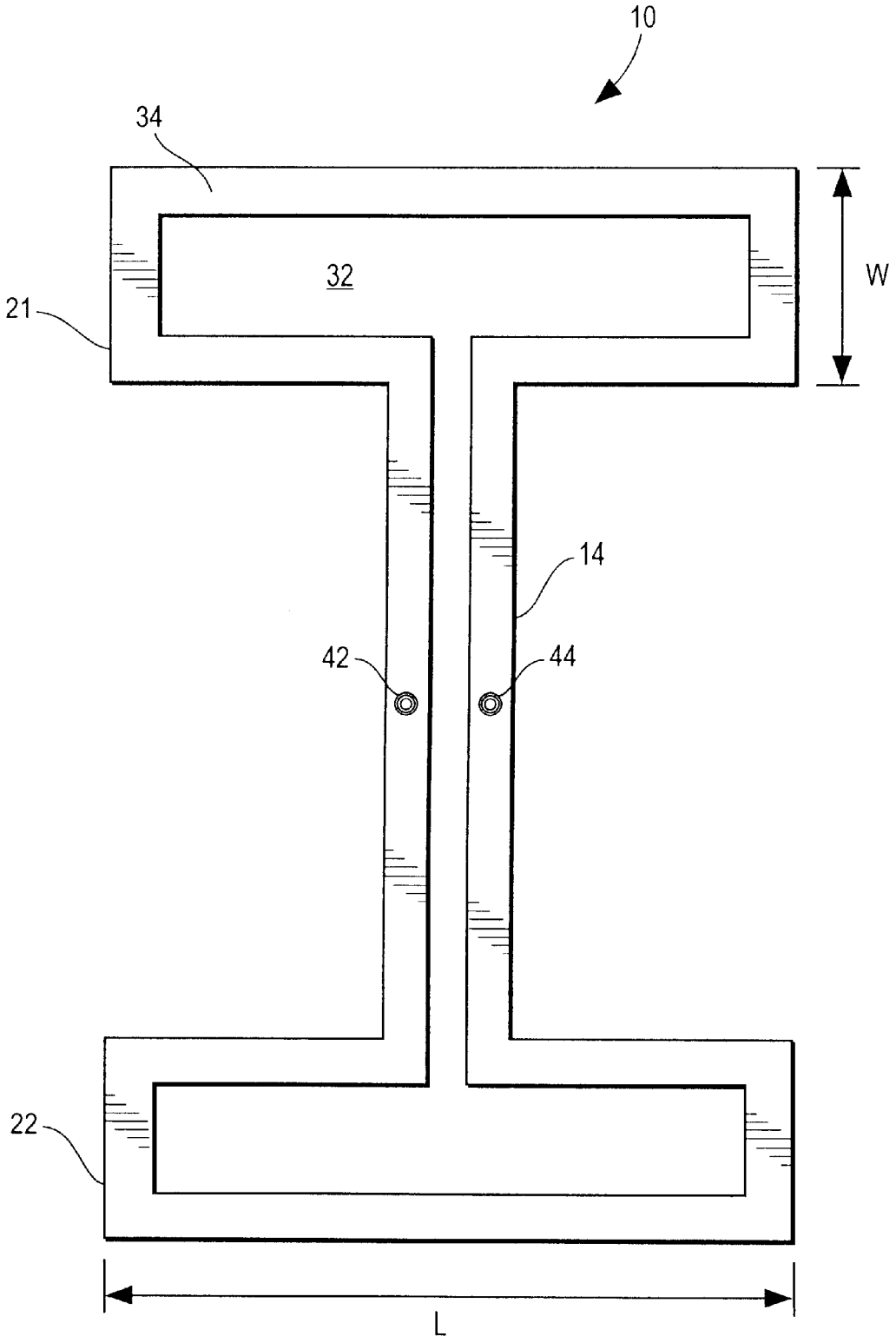
FIG. 1*c* illustrates a top view of a conductor before it is bent into the twin folded dipole antenna of FIG. 1*a;*

Referring to FIG. 1*c*, there is shown a top view of a conductor 14 before it is bent into the twin folded dipole antenna 10 as shown in FIG. 1*a*. A hole 42 is provided to aid in connecting the twin folded dipole antenna 10 to a conductor of a transmission line or RF device. One or more holes 44 are provided to facilitate attachment of one or more dielectric supports between the feed section 20 and the ground plane 12. The dielectric supports may include spacers, nuts and bolts with dielectric washers, screws with dielectric washers, etc.

Figure 2:
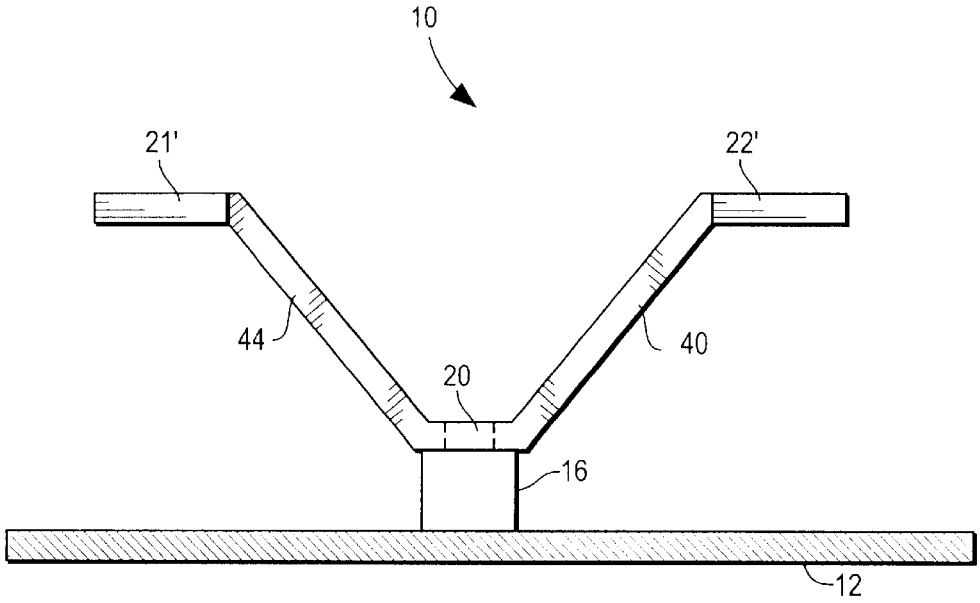
FIG. 2 illustrates a side view of a twin folded dipole antenna according to a further embodiment of the present invention.

In another embodiment shown in FIG. 2, the conductor 14 is bent to form radiating sections 21', 22'. In this embodiment, the conductor 14 is bent such that the passive dipoles of each radiating section 21' and 22' are generally parallel to the ground plane 12.

Figure 3:
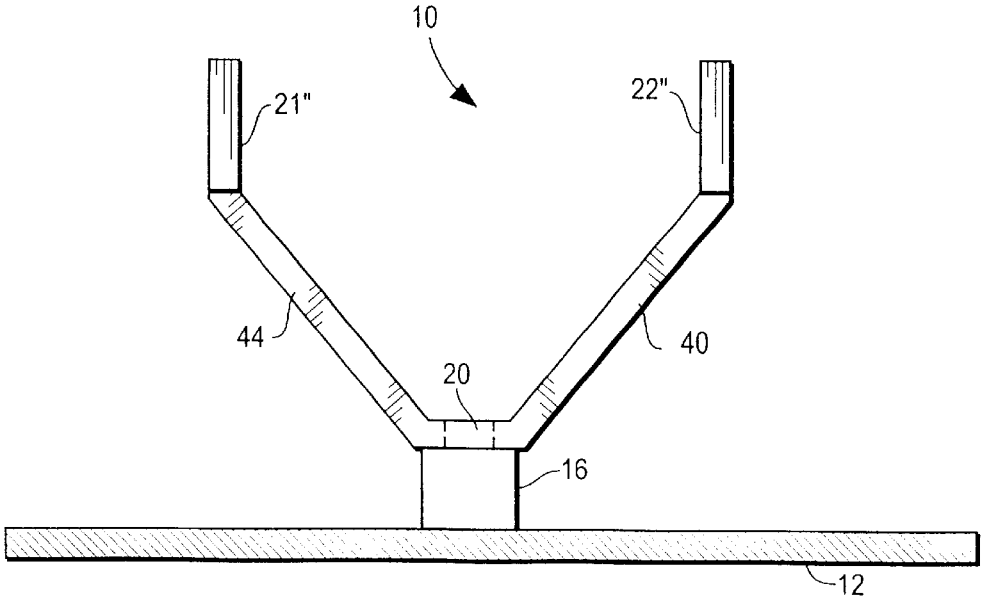
FIG. 3 illustrates a side view of a twin folded dipole antenna according to another embodiment of the present invention.

In yet another embodiment shown in FIG. 3, the conductor 14 is bent to form radiating sections 21", 22".

In this embodiment, the conductor 14 is bent such that the passive dipoles of each radiating section 21" and 22" are generally orthogonal to the ground plane 12.

In the illustrated embodiments, regardless of how the conductor 14 is bent, the passive dipole 26 is disposed parallel to and spaced from the fed dipole 24 to form a gap 32. The passive dipole is shorted to the fed dipole 24 at opposing ends 34 and 36 of the gap 32. The gap 32 has a length L and a width W, where the length L, is greater than the width W. In one embodiment where the twin folded dipole antenna 10 is used in the UMTS band of frequencies, the gap length L=2.24" and the gap width W=0.20" while the fed dipole 24 length is 2.64" and the fed dipole 24 width is 0.60".

Figure 4A:
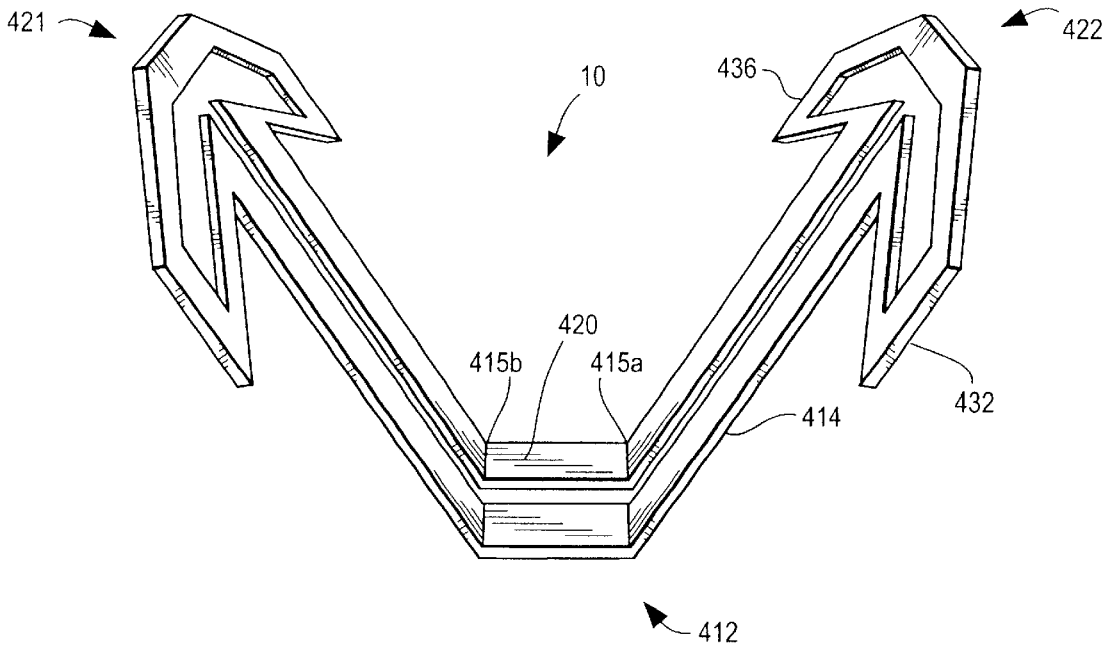
FIG. 4*a* illustrates an isometric view of a twin folded dipole antenna according to still another embodiment of the present invention.

In another embodiment shown in FIG. 4*a*, radiating sections 421, 422 are supported on a ground plane 412 and are generally angular thereto, at an angle of approximately 45 degrees. A conductor 414 is bent at bends 415*a* and 415*b* such that the feed section 420 is supported by and displaced from the ground plane 412. The ends 432, 436 of the radiating sections 421, 422 are bent downward towards the ground plane 412. This configuration minimizes the size of the resulting twin folded dipole antenna. In addition, bending the radiating sections 421, 422 increases the E-plane Half Power Beamwidth (HPBW) of the far-field pattern of the resulting twin folded dipole antenna. This embodiment is particularly attractive for producing nearly identical E-plane and H-plane co-polarization patterns in the far-field. In addition, one or more such radiating sections may be used for slant-45 degree radiation, in which the radiating sections are arranged in a vertically disposed row, with each radiating section rotated so as to have its co-polarization at a 45 degree angle with respect to the center axis of the vertical row. In the downwardly bent radiation section embodiment, when patterns are cut in the horizontal plane for the vertical and horizontal polarizations, the patterns will be very similar over a broad range of observation angles.

Figure 4B:
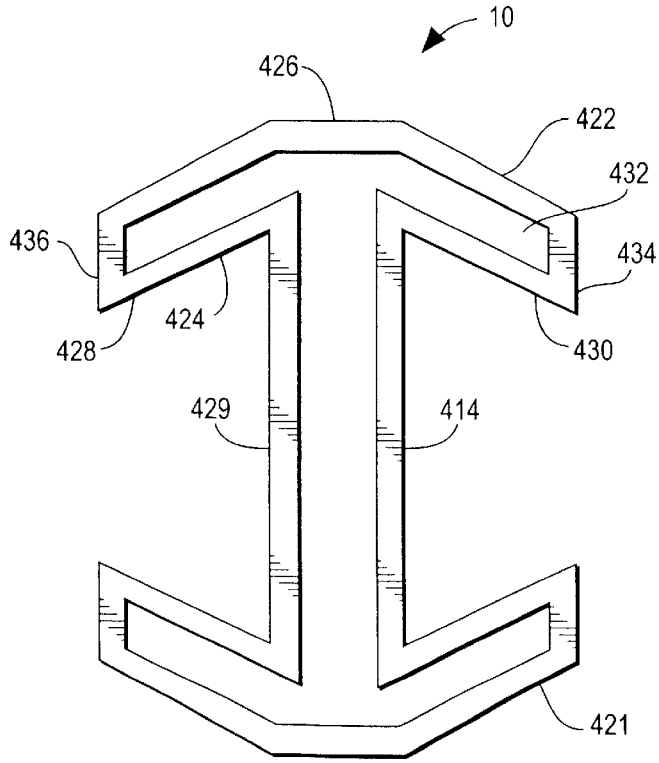
FIG. 4*b* illustrates a top view of a conductor before it is bent into the twin folded dipole antenna of FIG. 4*a;*

FIG. 4*b* illustrates a top view of the conductor 414 before it is bent into the twin folded dipole antenna of FIG. 4*a*. In the embodiment of FIGS. 4*a* and 4*b*, a passive dipole 426 is disposed in spaced relation to a fed dipole 424 to form a gap 432. The passive dipole 426 is shorted to the fed dipole 424 at the ends 434 and 436. The gap 432 forms a first half-wavelength dipole (passive dipole 426) on one side of the gap 432 and a second half-wavelength dipole (fed dipole 424) on the other side of the gap 432. Fed dipole 424 includes a centrally-located gap 429 which forms the first quarter-wavelength monopole 428 and the second quarter-wavelength monopole 430. In one embodiment where the antenna is used in the cellular band of 824–896 MHz and the GSM band of 870–960 MHz, the fed dipole 424 length L is about 6.52", and the fed dipole 424 width W is about 0.48". In this embodiment, the innermost section of the fed dipole 424 is a distance d from the top of the ground plane 412, where the distance d is about 2.89".

Figure 5:
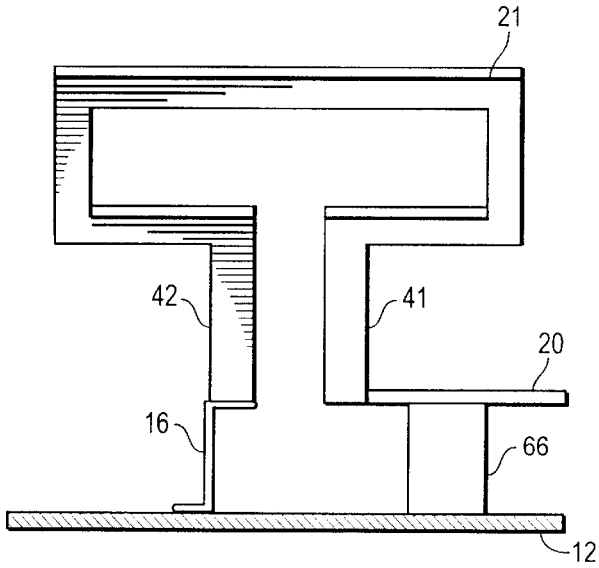
FIG. 5 illustrates a side view of a twin folded dipole antenna according to still another embodiment of the present invention where the transmission medium is airline.

The following embodiments refer to termination of the twin folded antenna 10 described above and in FIGS. 1*a*–4*b*. Each of the following embodiments of termination may be used for any of the twin folded dipole antenna 10 embodiments described herewith. Depicted in FIG. 5 is an airline embodiment of the twin folded dipole antenna 10. As is known in the art, "airline" refers to a transmission line system where the primary dielectric is air. In such an embodiment, the conductor section 42 is connected to the ground plane 12 at connection point 16. The twin folded dipole antenna 10 is supported above the ground plane 12 by a dielectric support 66 that is bonded to both the feed section 20 and the ground plane 12. Any suitable fastening device connects the conductor section 42 to the ground. plane 12. A suitable connection device provides both electrical and mechanical connections between the conductor 14 and the ground plane 12.

Figure 6A:
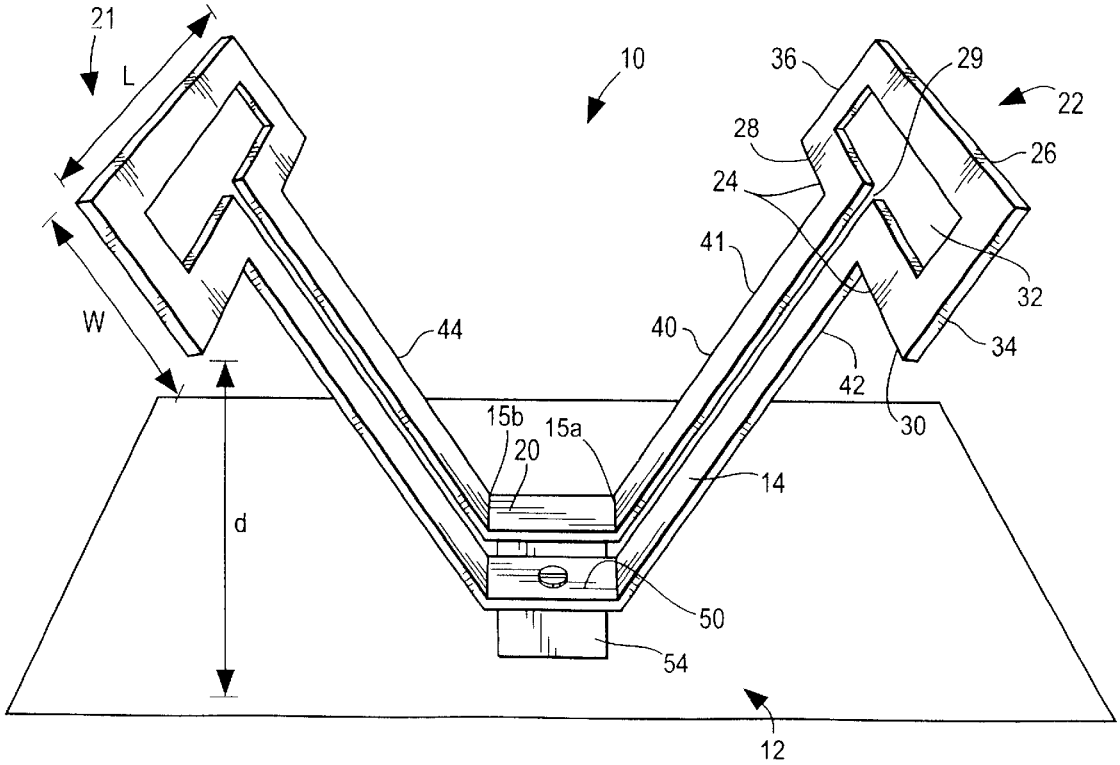
FIG. 6*a* illustrates an isometric view of a twin folded dipole antenna terminated by a quarter wavelength stub.
Figure 6B:
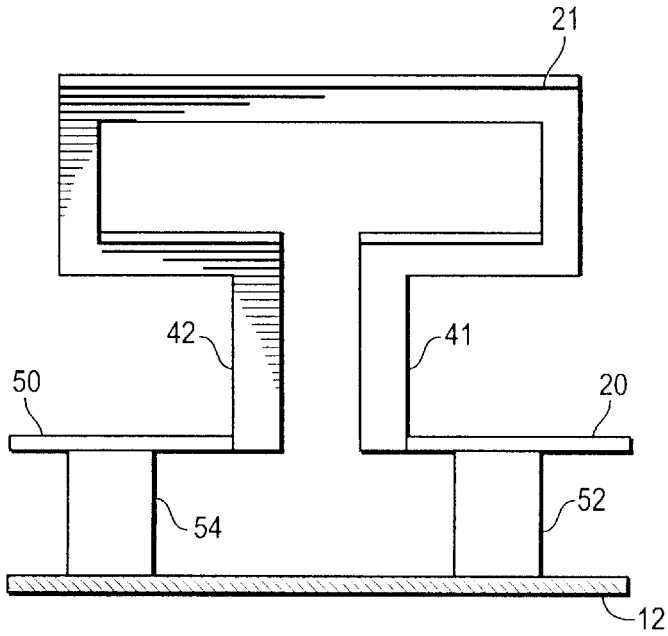
FIG. 6*b* illustrates a side view of a conductor as in the twin folded dipole antenna of FIG. 6*a;*

Depicted in FIG. 6*a* is an airline embodiment with a ¼ wavelength stub 50. In such an embodiment, the conductor section 42 terminates in an open-ended transmission line stub 50 that is not electrically connected to the ground plane 12. Rather, the stub 50 is supported above the ground plane 12 by a dielectric spacer 54 which is, for example, bonded to both the stub 50 and the ground plane 12. Further, a dielectric spacer 52 supports the feed section 20 above the ground plane 12. FIG. 6*b* schematically illustrates a side view of a portion of the twin folded dipole antenna 10 10, including dielectric spacers 52,54.

Figure 7:
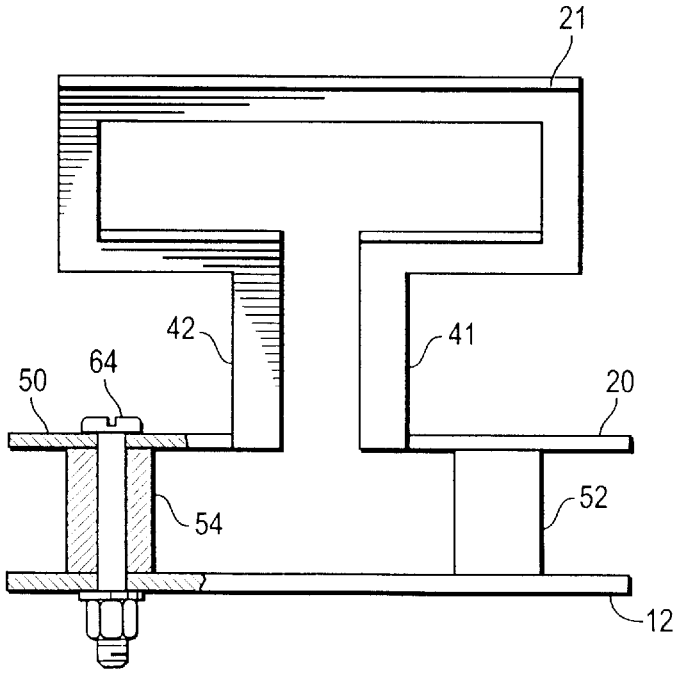
FIG. 7 illustrates a side view of a twin folded dipole antenna according to still another embodiment of the present invention.

Alternatively, the stub 50 may be secured to the ground plane 12 by a dielectric fastener that extends through the stub 50 and the ground plane 12 at location 16, as shown in FIG. 7. The length of the stub 50 is a quarter wavelength at the operating frequency of the twin folded dipole antenna 10. Since the end of the stub 50 forms an open-circuit, there will appear to be an electrical short to ground at the end of the conductor section 42 when the twin folded dipole antenna 10 is excited at its operating frequency. This causes the twin folded dipole antenna 10 to operate in the same manner as if the conductor section 42 were electrically connected to the ground plane 12. With this arrangement, there are no electrical connections to ground in the radiating element structure. Further, DC grounding for an array of antennas may be provided by electrically connecting one end of a quarter-wavelength shorted transmission line (not shown) to the feed section 20.

The advantage provided by this open-ended-stub embodiment is that the number of electrical connections between the twin folded dipole antenna 10 and the grounded plane is reduced from one connection per two radiating sections to one connection per array of twin folded dipole antennas. This embodiment substantially reduces manufacturing time, reduces the number of parts required for assembly and reduces the cost of the resulting twin folded dipole antenna array. These advantages are considerable where the array of twin folded dipole antennas contains a large number of radiating sections. The open-ended stub described above may be used in any of the embodiments illustrated in FIGS. 1*a*–11.

Figure 8:
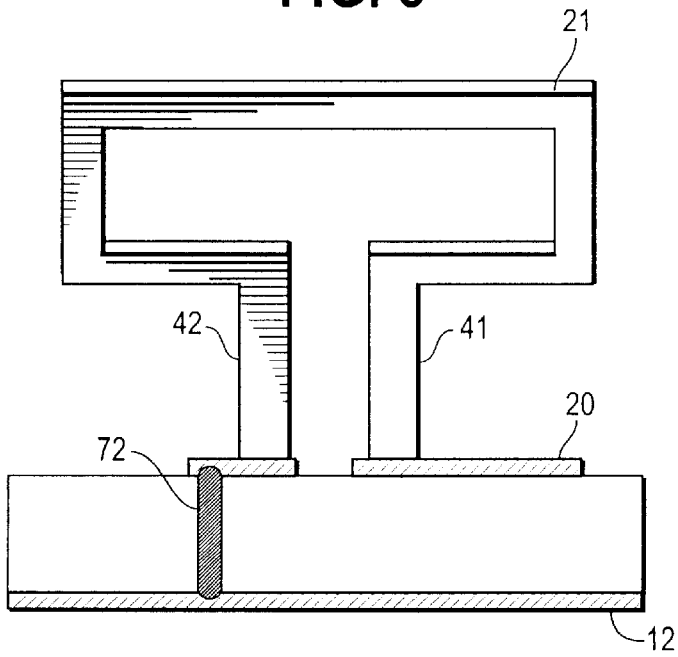
FIG. 8 illustrates a side view of a twin-folded dipole antenna according to still another embodiment of the present invention.

The above embodiments refer to airline implementations of embodiments of the twin folded dipole antenna 10. Embodiments of the twin folded dipole antenna 10 may also include PCB implementations where the PCB generally provides better reliability and joint strength than the airline implementations. FIG. 8 shows an embodiment similar to FIG. 1*a* but where the twin folded dipole antenna 10 is bonded electrically and mechanically to a PCB. In such an embodiment, the conductor section 42 is connected to the ground plane 12 by a plated-thru hole 72. As is known in the art, a plated-thru hole is a tunnel, commonly plated with copper and coated with solder to connect a topside pad to the bottom side of a PCB.

Figure 9:
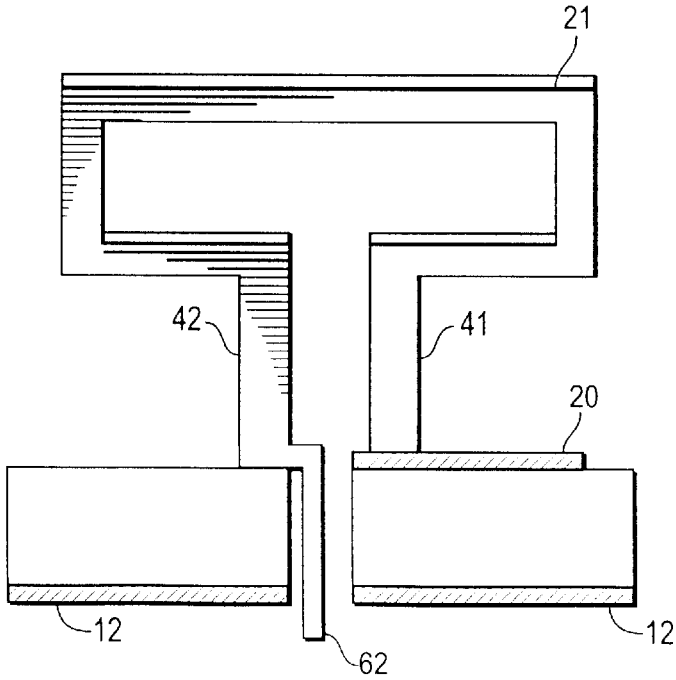
FIG. 9 illustrates a side view of a twin-folded dipole antenna according to still another embodiment of the present invention.

FIG. 9 shows still another embodiment of a PCB embodiment where a tab 62 connects the conductor section 42 to the ground plane 12. The tab 62 is integral to the single metal conductor 14 and the tab 62 bent to provide electrical and mechanical connection to the ground plane 12. The one piece construction of the twin folded dipole antenna 10 substantially reduces manufacturing time and reduces the number of parts required for assembly. Thus, the cost of the resulting twin folded dipole antenna 10 may be decreased by utilizing the embodiment of FIG. 9.

Figure 10:
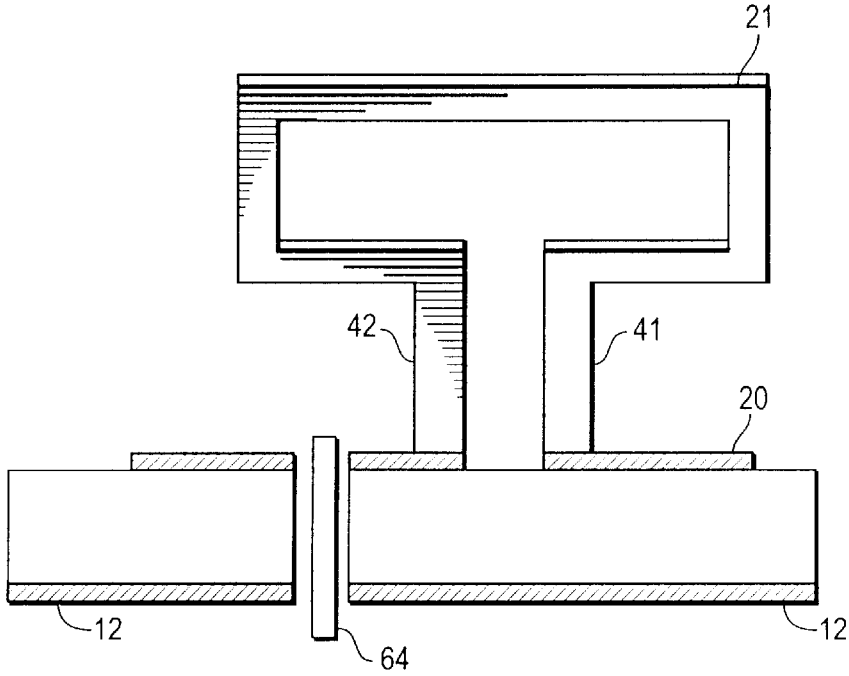
FIG. 10 illustrates a side view of a twin-folded dipole antenna according to still another embodiment of the present invention.

FIG. 10 shows still another embodiment of a PCB embodiment where a conductive component 64 connects the conductor section 42 to the ground plane 12. The conductive component 64 is distinct and separate from the conductor 14 but provides electrical and mechanical connection to the ground plane 12. The conductive component 64 42 may be a metal conductor, separate wire, or other similar conductive part.

Figure 11:
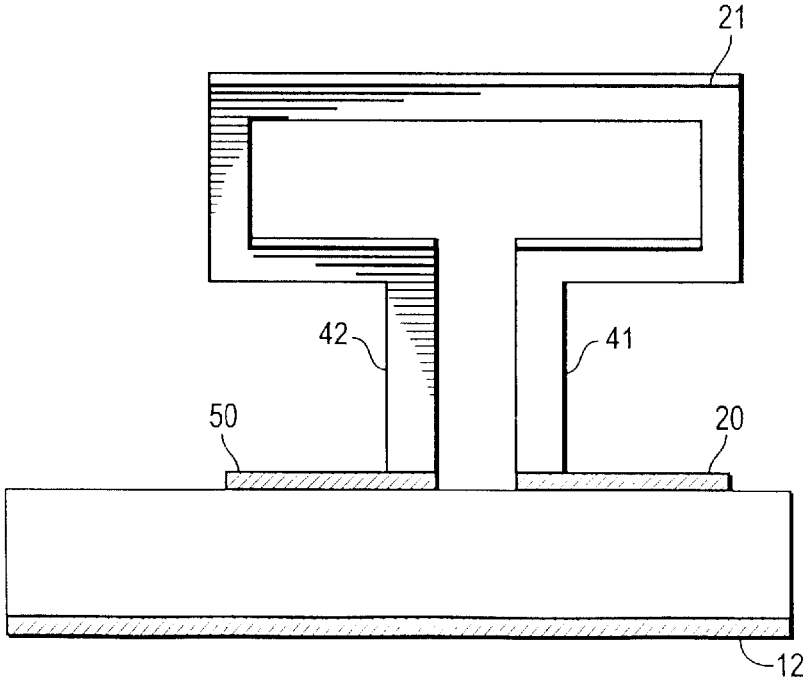
FIG. 11 illustrates a side view of a twin folded dipole antenna according to still another embodiment of the present invention.

FIG. 11 shows still another embodiment similar to FIG. 4 but where the twin folded dipole antenna 10 is bonded electrically and mechanically to a PCB. The conductor section 42 terminates in a transmission line stub 50 that is not electrically and mechanically connected to the ground plane 12. As in FIG. 6, the length of the stub 50 in FIG. 11 is a quarter wavelength at the operating frequency of the twin folded dipole antenna 10.

Although the illustrated embodiments show the conductor 14 forming, two radiating sections 21 and 22, the twin folded dipole antenna 10 would operate with as few as one radiating section or with multiple radiating sections.

The twin folded dipole antenna 10 of the present invention provides one or more radiating sections that are integrally formed from the conductor 14. Each radiating section is an integral part of the conductor 14. Thus, there is no need for separate radiating elements (i.e., radiating elements that are not an integral part of the conductor 14) or fasteners to connect the separate radiating elements to the conductor 14 and/or the ground plane 12. The entire conductor 14 of the twin folded dipole antenna 10 can be manufactured from a single piece of conductive material such as, for example, a metal sheet comprised of aluminum, copper, brass or alloys thereof. This improves the reliability of the twin folded dipole antenna 10, reduces the cost of manufacturing the twin folded dipole antenna 10 and increases the rate at which the twin folded dipole antenna 10 can be manufactured. The one piece construction of the bendable conductor embodiment is superior to prior antennas using dielectric substrate microstrips because such microstrips can not be bent to create the radiating sections shown, for example, in FIGS. 1*a*–11.

Each radiating section, such as the radiating sections 21, 22 in the twin folded dipole antenna 10 of FIG. 1*a*, is fed by a pair of conductor sections, such as the conductor sections 41 and 42 in the twin folded dipole antenna 10 of FIG. 1*a*, which form a balanced edge-coupled stripline transmission line. Since this transmission line is balanced, it is not necessary to provide a balun. The result is a twin folded dipole antenna 10 with very wide impedance bandwidth (e.g., 24%). The impedance bandwidth is calculated by subtracting the highest frequency from the lowest frequency that the antenna can accommodate and dividing by the center frequency of the antenna. In one embodiment, the twin folded dipole antenna 10 operates in the PCS, PCN and UMTS frequency bands. Thus, the impedance bandwidth of this embodiment of the twin folded dipole antenna 10 is:

$$(2170\ \text{MHz}-1710\ \text{MHz})/1940\ \text{MHz}=24\%$$

Besides having wide impedance bandwidth, the twin folded dipole antenna 10 displays a stable far-field pattern across the impedance bandwidth. In the wireless frequency band (1710–2170 MHz) embodiment, the twin folded dipole antenna 10 is a 90 degree azimuthal, half power beam width (HPBW) antenna, i.e., the antenna achieves a 3 dB beamwidth of 90 degrees. To produce an twin folded dipole antenna 10 with this HPBW requires a ground plane with sidewalls. The height of the sidewalls is 0.5" and the width between the sidewalls is 6.1". The ground plane in this embodiment is aluminum having a thickness of 0.06". In another wireless frequency band (1710–2170 MHz) embodiment, the twin folded dipole antenna 10 is a 65 degree azimuthal HPBW antenna, i.e., the antenna achieves a 3 dB beamwidth of 65 degrees. To produce an antenna with this HPBW also requires a ground plane with sidewalls. The height of the sidewalls is 1.4" and the width between the sidewalls is 6.1". The ground plane in this embodiment is also aluminum having a thickness of 0.06".

The twin folded dipole antenna 10 can be integrated into existing single-polarization antennas in order to reduce costs and increase the impedance bandwidth of these existing antennas to cover the cellular, GSM, PCS, PCN, and UMTS frequency bands.

While the present invention has been described with reference to one or more preferred embodiments, those skilled in the art will recognize that many changes may be made thereto without departing from the spirit and scope of the present invention which is set forth in the following claims.

What is claimed is:

1. A single piece twin folded dipole antenna for transmitting and receiving electromagnetic signals comprising:

a V-shaped conductor whereby the length of the V extends at an angle of approximately 45 degrees adjacent a ground plane, the conductor comprising a feed section, a radiator input portion, and a radiating portion;

the radiator input portion comprising a first radiator input section and a second radiator input section whereby the radiator input sections are integrally formed with the radiating portion;

the radiating portion comprising a first radiating section and a second radiating section connected in parallel whereby each radiating section comprises a fed dipole and a passive dipole, the fed dipole being connected to the radiator input portion, the passive dipole being disposed in spaced relation to the fed dipole to form a gap; and wherein the feed section, the radiator input portion, and the radiating portion are formed from a sheet of material.

2. The single piece twin folded dipole antenna of claim 1 wherein the ground plane is located on a printed circuit board electrically and mechanically attached to the conductor.

3. The single piece twin folded dipole antenna of claim 1 wherein the ground plane is located on an airline.

4. The single piece twin folded dipole antenna of claim 1 wherein the radiator input portion is electrically and mechanically connected to a ground plane by a tab integrally formed with the conductor.

5. The single piece twin folded dipole antenna of claim 1, wherein the feed section further comprises a feed forming network.

6. The single piece twin folded dipole antenna of claim 1, wherein the feed section is electrically connected to the printed circuit board whereby the printed circuit board comprises a feed forming network.

7. The single piece twin folded dipole antenna of claim 1, wherein the conductor terminates in a stub that is electrically connected to a ground plane.

8. The single piece twin folded dipole antenna of claim 7, wherein the antenna has an operating frequency, the length of the stub being a quarter wavelength at the operating frequency.

9. The single piece twin folded dipole antenna of claim 7, wherein the termination stub is displaced from a ground plane and insulated there from.

10. The single piece twin folded dipole antenna of claim 1, wherein the radiating input portion is supported adjacent to and insulated from a ground plane by a dielectric.

11. The single piece twin folded dipole antenna of claim 10, wherein the dielectric is a spacer.

12. The single piece twin folded dipole antenna of claim 10, wherein the dielectric is foam.

13. The single piece twin folded dipole antenna of claim 1, further comprising a quarter-wavelength transmission line electrically connected between the feed section and the ground plane.

14. The single piece twin folded dipole antenna of claim 1, wherein the first radiating section and the second radiating section are bent downwards toward the ground plane.

15. The single piece twin folded dipole antenna of claim 14, wherein the first radiating section and the second radiating section are bent so that they are parallel to the ground plane.

16. The single piece twin folded dipole antenna of claim 1, wherein the passive dipole is disposed parallel to the fed dipole.

17. The single piece twin folded dipole antenna of claim 1, wherein the gap has a length and a width, the length being greater than the width.

18. The single piece twin folded dipole antenna of claim 1, wherein the conductor comprises an RF input section that is adapted to electrically connect to an RF device.

19. The single piece twin folded dipole antenna of claim 1, wherein the material is metal.

20. A method of making a single piece twin folded dipole antenna for transmitting and receiving electromagnetic signals comprising providing a conductor comprising three sections, a feed section, a radiator input portion, and a radiating portion whereby the radiator input portion is integrally formed with the radiating portion and the feed section, the radiating portion comprising a first radiating section and a second radiating section whereby each radiating section comprises a fed dipole and a passive dipole;

extending the radiator input portion at an angle of approximately 45 degrees from a ground plane;

forming the radiating portion into the first radiating section and the second radiating section where each radiating section is displaced from the ground plane;

spacing the passive dipole from the fed dipole to form a gap; and connecting the first radiating section in parallel to the second radiating section.

21. The method of claim 20, whereby the radiator input portion further comprises a V-shaped conductor where the first radiator input section and the second radiator input section form the sides of the conductor.

22. The method of claim 21, further comprising supporting the first radiating input section from the ground plane by a dielectric.

23. The method of claim 22, wherein the dielectric is a spacer.

24. The method of claim 22, wherein the second dielectric is a foam.

25. The method of claim 21, wherein the first radiator input section comprises a first conductor section and a second conductor section separated by a second gap whereby the first and second conductor sections are parallel to each other.

26. The method of claim 20, further comprising displacing the radiating portion from the ground plane and insulating the radiating portion there from.

27. The method of claim 20, wherein the antenna has an operating frequency, and further comprising electrically connecting a transmission line measuring a quarter-wavelength at the operating frequency, between the feed section and the ground plane.

28. The method of claim 20, further comprising bending the first radiating section and second radiating section downward towards the ground plane.

29. The method of claim 28, wherein the first radiating section and the second radiating section are bent so that they lie parallel to the ground plane.

30. The method of claim 20, further comprising integrally forming the conductor from a sheet of metal.

31. The method of claim 20, further comprising interposing a dielectric between the conductor and the ground plane.

32. The method of claim 20, further comprising the second radiator input section extending to a termination stub whereby the length of the termination stub is a quarter wavelength at an operating frequency of the antenna.

33. The method of claim 20, further comprising forming the first radiator input section as a first conductor section and a second conductor section separated by a third gap.

34. The method of claim 20, further comprising disposing the passive dipole parallel to the fed dipole.

35. The method of claim 20, wherein the gap has a length and a width, the length being greater than the width.

36. The method of claim 20, further comprising forming a part of the conductor into an RF input section that is adapted to electrically connect to an RF device.

37. The method of claim 20, wherein the first radiating section and the second radiating section are bent so that they lie orthogonal to the ground plane.

38. The method of claim 20, wherein the conductor is electrically and mechanically connected to a printed circuit board comprising the ground plane.

39. The method of claim 20 wherein the ground plane is located on an airline.

40. A twin folded dipole antenna for transmitting and receiving electromagnetic signals comprising:

means for providing a conductor comprising three sections, a feed section, a radiator input portion, and a radiating portion whereby the radiator input portion is integrally formed with the radiating portion and the feed section, the radiating portion comprising a first radiating section and a second radiating section whereby each radiating section comprises a fed dipole and a passive dipole;

means for extending the radiator input portion at an angle of approximately 45 degrees from a ground plane;

means for forming the radiating portion into the first radiating section and the second radiating section where each radiating section is displaced from the ground plane;

means for spacing the passive dipole from the fed dipole to form a gap; and means for connecting the first radiating section in parallel to the second radiating section.

* * * * *

UNITED STATES PATENT AND TRADEMARK OFFICE

CERTIFICATE OF CORRECTION

PATENT NO. : 6,650,301 B1
DATED : November 18, 2003
INVENTOR(S) : Zimmerman

It is certified that error appears in the above-identified patent and that said Letters Patent is hereby corrected as shown below:

Drawings,
Sheet 1, FIG. 1a, add reference numerals -- 16, --, -- 16a -- and -- 16b, -- and add a standoff structure 16a, 16b, below the antenna with reference numeral 16 pointing to the standoff structure where it meets the ground plane.
FIG. 1b, add reference numeral -- 16a, -- and modify the lead line to reference 16.
Sheet 2, FIG. 1c, replace reference numeral "42" with reference numeral -- 42a -- and replace reference numeral "44" with reference numeral -- 44a. --.
Sheet 3, FIG. 2 and 3, modify the lead line to reference 16.
Sheet 4, FIG. 4a, replace reference numeral "432" with reference numeral -- 434. --.
FIG. 4b, modify the lead line to reference numeral 429.
Sheet 5, FIG. 5, replace reference numeral "21" with reference numeral -- 22, -- and modify the lead line to reference numeral 16.
Sheet 6, FIG. 6b, replace reference numeral "21" with reference numeral -- 22, -- and modify the structure designed by reference numeral 20 to extend and include broken line.
FIG. 7, replace reference numeral "21" with reference numeral -- 22, --, replace reference numeral "64" with reference numeral -- 54a, -- and add reference numeral -- 16 --.
Sheet 7, FIGS. 8 and 9, replace reference numeral "21" with reference numeral -- 22. --.
Sheet 8, FIGS. 10 and 11, replace reference numberal "21" with reference numeral -- 22 --.

Column 2,
Lines 3-4, (Orginal application p.3, lines 8-9), "conductor as in the twin folded dipole antenna of FIG. 6a" should read -- conductor in a twin folded dipole antenna according to another embodiment of the present invention --.

Column 3,
Lines 22-24, (Original application p.5, line 32 through p.6, line 2), "one location 16. The radiating sections 21, 22 are supported at a distance d above the ground plane 12." should read -- one location 16 via a standoff 16a, support, bracket, or other suitable physical means that supports the conductor section 42. The radiating sections 21, 22 are supported at a distance d above the ground plane 12. a second standoff 16b, support, or bracket, which is a dielectric, may support the conductor section 41. --.
Lines 46-47, (Original application p.6, lines 25-26), "other end of conductor section 42 is connected to the ground plane 12 at locations 16."should read -- other end of conductor section 42 is electrically and physically connected to the ground plane 12 at location 16, via direct connection or by standoff 16a. --.

UNITED STATES PATENT AND TRADEMARK OFFICE

CERTIFICATE OF CORRECTION

PATENT NO. : 6,650,301 B1
DATED : November 18, 2003
INVENTOR(S) : Zimmerman

It is certified that error appears in the above-identified patent and that said Letters Patent is hereby corrected as shown below:

Column 3 (cont'd),
Lines 48-50, (Original application p.6, lines 28-30), "The conductor section 42 can be connected to the ground plane 12 by any suitable fastening device such as a nut and bolt, a screw, a rivet, or any suitable fastening method" should read as -- The conductor section 42 can be electrically and physically connected to the ground plane 12 by any suitable fastening device such as a nut and bolt, a screw, a rivet, including the standoff 16a, support, or bracket, or by any suitable fastening method --.

Column 4,
Line 25, (Original application p.8, line 9), "a hole 42" should read -- a hole 42a --.
Line 28, (Original application p.8, line 12), "holes 44" should read -- holes 44a --.
Line 60, (Original application p.9, line 11), "The ends 432, 436" should read -- The ends 434, 436 --.

Column 5,
Line 55, (Original application p.11, line 11), "10 10" should read -- 10 --.
Line 58, (Original application p.11, line 14), "a dielectric fastener" should read -- a dielectric fastener 54a --.

Column 6,
Line 51, (Original application p.13, lines 11-12), "FIG. 4" should read -- FIG. 8 --.

Signed and Sealed this

Twenty-eighth Day of February, 2006

JON W. DUDAS
*Director of the United States Patent and Trademark Office*